United States Patent [19]

Lofquist et al.

[11] 3,989,455

[45] Nov. 2, 1976

[54] TERTIARY AMINES, SUBSTITUTED PIPERIDINE, MORPHOLINE OR PIPERAZINE CONTAINING FATTY ACID MOIETIES TO PREVENT OZONE FADING OF NYLON FIBERS

[75] Inventors: Robert Alden Lofquist; John Christopher Haylock, both of Richmond, Va.

[73] Assignee: Allied Chemical Corporation, Petersburg, Va.

[22] Filed: Nov. 4, 1974

[21] Appl. No.: 520,704

Related U.S. Application Data

[63] Continuation-in-part of Ser. No. 364,788, May 29, 1973, abandoned.

[52] U.S. Cl. ..... 8/165; 8/169

[51] Int. Cl.[2] ..... D06P 5/00; D06P 5/02

[58] Field of Search ..... 8/168, 74

[56] References Cited

UNITED STATES PATENTS

| | | | |
|---|---|---|---|
| 2,409,325 | 10/1946 | Ward | 8/165 |
| 2,706,142 | 4/1955 | Van Glahn | 8/165 |
| 3,495,929 | 2/1970 | Kleeman | 8/165 |
| 3,785,767 | 1/1974 | Hildebrand | 8/169 |

OTHER PUBLICATIONS

Salvin, Tex. Res. Jour., July 1955, pp. 571–585.

*Primary Examiner*—Donald Levy
*Attorney, Agent, or Firm*—Richard A. Anderson

[57] ABSTRACT

A method of treating polycarbonamide fiber, such as nylon 6 yarn for carpets, has been discovered to increase dye fastness when the dyed fiber is exposed to ozone. The method is coating the fibers with a tertiary amine, or a substituted piperidine, morpholine, or piperazine compound. The compound must contain at least one moiety of straight or branched chain alkyl, alkenyl or aralkyl containing 6 to 24 carbon atoms.

2 Claims, No Drawings

TERTIARY AMINES, SUBSTITUTED PIPERIDINE, MORPHOLINE OR PIPERAZINE CONTAINING FATTY ACID MOIETIES TO PREVENT OZONE FADING OF NYLON FIBERS

CROSS-REFERENCE TO RELATED APPLICATION

This application is a continuation-in-part of our copending application Ser. No. 364,788, filed May 29, 1973 now abandoned.

BACKGROUND OF THE INVENTION

The object of this invention is to reduce or prevent the fading of dyed nylon fabrics caused by the presence of ozone. By fading is meant the decrease in concentration of a dye in the fiber such that the fiber becomes less intensely colored or changes color, for example, dark blue to light blue, or green to yellow because of the loss of a blue dye.

Ozone is normally present in air at sea level at concentrations of about 1 to 5 parts per hundred million. Despite this extremely low concentration, severe fading, caused by ozone, has been observed.

Ozone is an allotropic form of oxygen. The molecule of ordinary oxygen consists of two atoms of oxygen whereas the molecule of ozone is formed from three atoms of oxygen. Ozone is created in the upper atmosphere by the action of high energy radiation from the sun splitting oxygen molecules into separate oxygen atoms. The individual atoms then combine with diatomic oxygen molecules ($O_2$) to form triatomic ozone ($O_3$). This ozone then diffuses down through the atmosphere.

Ozone is a vigorous electrophilic reagent, that is, it acts by sharing electrons which previously belonged exclusively to another molecule (see C. K. Ingold's "Structure and Mechanism in Organic Chemistry", Cornel University Press, 1953, page 201). An example of this sharing is the attack of ozone on a carbon-carbon double bond to form an ozonide.

When ozone attacks a dye, it can attack at a double bond in the dye or at an amine nitrogen, or other sites where there are electron pairs available. The dyes which are attacked are usually anthraquinone type dyes. Lebensaft in his doctoral dissertation (University of North Carolina at Greensboro, 1970) stated that ozone attacks the anthraquinone nucleus to form derivatives of phthalic acid.

Disperse type dyes and cationic dyes are those most frequently attacked, but under severe conditions, it is believed that almost all dyes are affected by ozone.

One of the most sensitive dyes to ozone fading is Disperse Blue 3. The major constituent of Disperse Blue 3 has the structure:

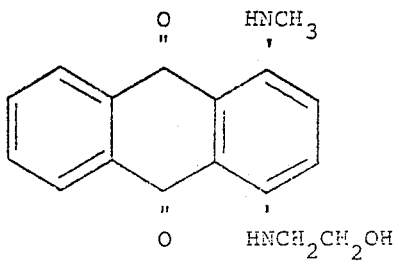

It is believed that the dye diffuses through the fiber to contact the ozone at the surface of the fiber, rather than ozone diffusing through the fiber to a relatively immobile dye. Part of the evidence for this is that any physical treatment to the fiber that increases the mobility of the dye, increases its ozone fading. For this reason, it is felt that any protective agent must also be able to diffuse through the fiber, if it does not form an impenetrable film on the surface of the fiber.

There is some evidence that water molecules must be present in the nylon fiber in order for ozone fading to take place, but whether its action is that of a swelling agent or it is involved in a primary or secondary oxidation step is unclear. Lebensaft, cited above, believes it functions principally as a swelling agent and a carrier.

Ozone fading can be decreased by reduction of the specific surface of the yarn. This reduction is undesirable in end-uses that need a bulky yarn. Ozone fading also can be diminished by changes in polymer morphology and orientation, but these techniques are inherently expensive.

Prior methods of improving ozone fading resistance either affect the rate of dyeing, the leveling properties of the dye-fiber system, or have poor dyed light-fastness, at least in some shades.

SUMMARY OF THE INVENTION

A method and composition have been found for improving the fastness of dyes when exposed to ozone in polycarbonamide fiber with no detrimental effects such as decreased light fastness of certain red and other dyes. The method consists of treating polycarbonamide fibers to increase dye fastness of the dyed fibers when exposed to ozone comprising coating the fibers with from about 0.5 percent to about 4.0 percent on weight of fiber of a compound selected from the group consisting of

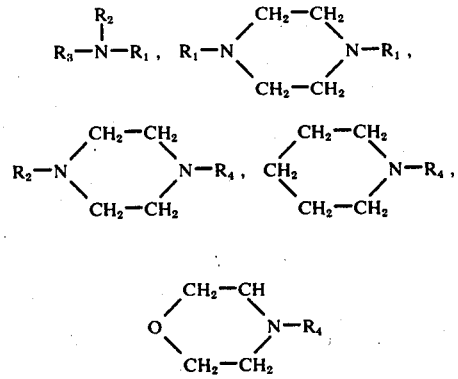

and where $R_1$ is straight or branched alkyl, alkenyl or aralkyl having 6 to 24 carbon atoms; $R_2$ is the same as $R_1$, another $R_1$ or a straight or branched chain alkyl or alkenyl having 1 to 6 carbon atoms; $R_3$ is the same as $R_2$ or another $R_2$; $R_4$ is an $R_1$ having 11 to 24 carbon atoms; the total carbon atoms in $R_1$, $R_2$ and $R_3$ must be at least 15 and less than 40; and $R_1$, $R_2$, $R_3$, and $R_4$ can contain up to 2 unsaturated carbon-carbon bonds. These compounds can be coated on the fibers prior to dyeing, concurrently to dyeing by adding the compound to a dyebath or subsequent to dyeing the fiber. A preferred range of the coating of compound is from about 0.6 percent to about 3.0 percent on weight of fiber.

The following examples show compositions and methods using straight and branched alkyl, alkenyl or aralkyl tertiary amines where at least 1 moiety has 6 to 24 carbon atoms and a similarly substituted fatty acid morpholine. The similarly substituted piperadines and piperazines are so closely related that one skilled in the art would expect equivalent ozone protection in dyes in nylon.

In addition to protection from ozone fading, the compounds of this invention have an added benefit, not available from prior art compounds, of also providing light fastness of certain red and other dyes as shown in the comparison of Examples 11–13.

DESCRIPTION OF THE PREFERRED EMBODIMENTS

Some of the preferred embodiments of this invention are set forth in the following examples. The method of testing sensitivity to ozone fading was similar to the AATCC 129-1972 test method given in Volume 48 of the AATCC Technical Manual.

The degree of fading after exposure to ozone was measured on a Hunter Color Difference Meter. The measurement is given in terms of Δ E units, a smaller Δ E being associated with less fading. Δ E is calculated from the differences between the L, a, and b readings before the yarn is exposed to ozone, and the L, a and b readings after the yarn is exposed to ozone, using the equation: $\Delta E = \sqrt{(\Delta L)^2 + (\Delta a)^2 + (\Delta b)^2}$ "L" is a 0-100 reading of black to white; "a" Measures redness to greenness; and "b" Measures yellowness to blueness.

The Hunter Color Difference Meter is believed to measure color, as seen in average daylight, in a manner similar to the way in which the human eye responds to color. Experimentation has shown that the eye can match any color with a combination of three "primary" colored lights, and, therefore, that any color can be specified by a three-dimensional identification. The Color Difference Meter measures the light reflected by a specimen through filters that correspond to the three "primary" lights. The measurements made, therefore, correspond to the way the average human eye responds to light, as these responses are set forth in the CIE "Standard Observer". The "Standard Observer" is a table of values derived from experiments with human observers, and recommended for use in 1931 by the International Commission on Illumination.

EXAMPLE 1

Polymer made from caprolactam, having a formic acid relative viscosity of about 45, about 81 sulfonic groups from sodium sulfoisophthalate, about 85 carboxyl ends and about 20 amine ends per million grams of polymer, was spun into yarn having a Y cross-section with a 3.2 modification ratio. The yarn was coated with a commercial aqueous spin finish and drawn at a draw ratio of about 2.9 to give filaments of 15 denier.

The yarn was chopped into 7-inch lengths carded, and spun into staple yarn having a 2.25 cotton count. The yarn was knitted into sleeves, and heat set by steam treating in an autoclave at 230° F. for five minutes, followed by three ten-minute cycles of steam treatment at 270° F.

The sleeves were dyed to a moss green in a dyebath composed as follows:

0.3% Sevron Yellow 8GMF (DuPont) (CI Basic Yellow 53)

0.25% Astrazon Blue 3RL (Verona) (CI Basic Blue 47)

2.0% Hipochem PND-11 (amine salt of alcohol ester by Highpoint Chemical Co.)

1.0% Hipochem CDL-60 (nonionic surfactant from Highpoint) and monosodium and/or disodium phosphate to adjust the pH to 7.0 ± 0.2.

Astrazon Blue 3RL has been shown by analysis to be an anthraquinone dye of the following structure:

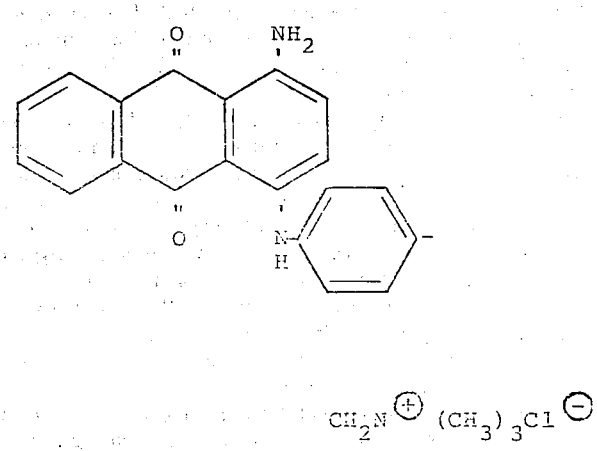

The sleeve was cut into sections about 5 inches long and each section was weighed. The sleeves were then soaked in the ethanol solutions listed below for 20 minutes. The sleeves were removed from the solutions, dried and reweighed. The amount of material coated on the sleeves from each solution was based on the difference in weight between the treated and untreated sleeves compared to the control, which had been soaked in pure ethanol.

The sleeves were then exposed to three cycles of ozone in an atmosphere containing about 80 parts per hundred million (pphm) of ozone at a temperature of 104° F., and a relative humidity of at least 95%. A cycle is that exposure which takes place when the internal nylon standard, dyed Olive I with disperse dyes, has faded sufficiently to give a Δ E of 2.8. The measurement of Δ E is discussed under "Description of the Preferred Embodiments" above. The solutions, the amount of coating, and the results of ozone exposure are listed as follows:

| Solution | % Pickup | ΔE |
|---|---|---|
| a). Triisooctylamine, 1 gm in 200 ml ethanol | 0.91 | 2.5 |
| b) Triisooctylamine, 2 gm in 200 ml ethanol | 2.1 | 1.4 |
| c) Dibenzylamine, 1 gm in 200 ml ethanol | 0.5 | 15.8 |
| d) Control, 200 ml ethanol | – | 23.0 |

EXAMPLE 2

Dyed yarns similar to those of Example 1 except non-autoclaved, were soaked in ethanol solutions as in Example 1, and exposed to ozone as in Example 1. The pickups of amine and the effect of exposure to ozone are listed below:

| Solution | % Pickup | ΔE |
|---|---|---|
| a) Control, in 200 ml ethanol | — | 10.4 |
| b) Triisooctylamine, 1 gm in 200 ml ethanol | 1.11 | 2.3 |
| c) Tribenzylamine, 1 gm in 200 ml ethanol | 0.96 | 5.3 |

A Δ E of 2.3 is noticeable but only slightly faded; A Δ E of 5.3 is somewhat badly faded, and a Δ E of 10.4 is severely faded. In all cases, the fading was such that the green color went toward a yellow, i.e., the fading is due to a destruction of the blue dye. Thus, after exposure sample "a" was yellow with a green cast, "b" was green with a yellowish cast, and "c" was a yellow green.

EXAMPLE 3

Dyed yarns similar to those of Example 1, except autoclaved at 260° F., rather than 270° F., were soaked in ethanol solutions as follows and exposed to ozone as in Example 1. The solutions, pickup of amine, and results of ozone exposure are listed below:

| Solution | % Pickup | ΔE |
|---|---|---|
| Dimethylstearylamine, 1 gm in 200 ml ethanol | 1.16 | 1.3 |
| Dimethylstearylamine,2 gm in 200 ml ethanol | 2.47 | 1.5 |
| Dimethyltallowamine 1 gm in 200 ml ethanol | 1.22 | 1.4 |
| Dimethyltallowamine, 2 gm in 200 ml ethanol | 2.33 | 1.7 |
| Trilaurylamine 1 gm in 200 ml ethanol | 0.80 | 6.8 |
| Trilaurylamine 2 gm in 200 ml ethanol | 2.24 | 2.7 |
| Triisooctylamine 1 gm in 200 ml ethanol | 1.10 | 5.4 |
| Triisooctylamine 2 gm in 200 ml ethanol | 2.17 | 2.3 |
| Tritridecylamine 1 gm in 200 ml ethanol | 1.04 | 11.0 |
| Tritridecylamine 2 gm in 200 ml ethanol | 2.25 | 5.3 |
| Control, just 200 ml ethanol | — | 27.4 |

These amines were obtained from Ashland Chemical Company, Columbis, Ohio. They are marketed under the tradename of ADOGENS.

EXAMPLE 4

Polymer made from caprolactam, having a relative formic acid viscosity of about 70, with about 60 equivalents of carboxyl and 15 equivalents of amine per million grams of polymer was spun into yarn. The yarn was coated with a commercial aqueous spin finish and drawn at a draw ratio of 3.0. The resulting drawn yarn had a Y cross-section with a 3.0 modification ratio and a filament denier of 15. This yarn as chopped into 7-inch lengths, carded and spun into staple yarn having a cotton count of 2.0. The yarn was knitted into sleeves, and heat set by treatment similar to that given the sleeves in Example 1.

The sleeves were dyed to an Olive I shade, a tertiary shade consisting of 0.069% on weight of fiber (O.W.F.) of an anthraquinone type dye, such as Celliton Blue FFRN (C.I. Disperse Blue 3), 0.0807% O.W.F. Celliton Pink RF, (C.I. Disperse Red 4) and 0.465% O.W.F. Celliton Yellow GA (C.I. Disperse Yellow 3). Disperse Blue 3 is especially sensitive to ozone.

The dyed sleeves were soaked in the following solutions, the amine pickup determined in the same way as in Example 1, and exposed to an atmosphere containing 80 pphm of ozone at a temperature of 104° F., and a relative humidity of about 95%, for three fading cycles.

The solutions, the amine pickup and the results of ozone exposure were:

| Solution | % Pickup | ΔE |
|---|---|---|
| Methyldi (30 % arachidyl-70 % behenyl)amine 1 gm in 200 ml ethanol | 1.42 | 2.6 |
| Methyldi(30 % arachidyl-70 % behenyl)amine 2 gm in 200 ml ethanol | 2.68 | 1.0 |
| Methyldi(90 % arachidyl-10 % behenyl)amine 1 gm in 200 ml ethanol | 0.74 | 7.9 |
| Methyldi(90 % arachidyl-10 % behenyl)amine 2 gm in 200 ml ethanol | 1.63 | 6.9 |
| Methyldicocoamine 1 gm in 200 ml ethanol | 1.22 | 6.9 |
| Methyldicocoamine 4 gm in 200 ml ethanol | 4.80 | 4.0 |
| Methyldi(hydrogenated tallow)amine 1 gm in 200 ml ethanol | 1.22 | 2.4 |
| Methyldi(hydrogenated tallow)amine 2 gm in 200 ml ethanol | 2.14 | 3.1 |
| Control, just 200 ml ethanol | — | 22.2 |

These chemicals were obtained from Humko Products, Chemical Division, Memphis, Tennessee. They are marketed under the tradename of KEMAMINES.

EXAMPLE 5

Dyed yarns similar to those of Example 1, were soaked in ethanol solutions of amines and exposed to ozone as in Example 1. The solutions, the amine pickup and the results and ozone exposure are listed below:

| Solution | % Pickup | ΔE |
|---|---|---|
| Triamylamine 2 gm in 200 ml ethanol | 0.84 | 15.8 |
| Triheptylamine 1 gm in 200 ml ethanol | 1.32 | 2.0 |
| Triheptylamine 2 gm in 200 ml ethanol | 2.46 | 0.6 |
| Tridecylamine 1 gm in 200 ml ethanol | 1.25 | 2.5 |
| Tridecylamine 2 gm in 200 ml ethanol | 1.97 | 2.9 |
| Tridodecylamine 1 gm in 200 ml ethanol | 0.92 | 7.4 |
| Tridodecylamine 2 gm in 200 ml ethanol | 1.84 | 3.7 |
| Tribenzylamine 1 gm in 200 ml ethanol | 1.03 | 11.7 |
| Tribenzylamine 2 gm in 200 ml ethanol | 1.88 | 12.6 |
| Control, just 200 ml ethanol | — | 18.8 |

EXAMPLE 6

Knitted sleeves were treated and dyed as in Examine 1. They were then exposed to three cycles of ozone at 20 pphm ozone, 104° F., and 95% relative humidity.

The amines sprayed on the yarn, the percent pickup (O.W.F.) and the visual evaluation of ozone protection are listed below:

| Chemical | % Pickup | Appearance relative to Control |
|---|---|---|
| a) Varonic K202P* | 2.7 | very slight fading |
| b) Dimethyltallowamine | 2.8 | very slight fading |
| c) N-Cocomorpholine | 2.9 | slightly more fading than above |
| d) Control | — | severe fading |

*Varonic K202P is cocoamine reacted with two moles of propylene oxide. It is sold by Varney Chemical Company, Des Plaines, Illinois.

The control sleeve had changed from a moss green to greenish yellow. The "a" and "b" sleeves were substantially moss green.

EXAMPLE 7

Undyed knitted sleeves were sprayed with antiozonants autoclaved at 270° F. and then dyed as in Example 6. They were then exposed to three cycles of ozone at 10 pphm ozone at 104° F. and 95% relative humidity.

The amines sprayed on the yarn, the percent (O.W.F.) pickup and then visual appearance after exposure to ozone are as follows:

| Chemical | % Pickup | Appearance relative to Control |
|---|---|---|
| a) Varonic K202P* | 2.0 | Unchanged |
| b) Dimethyltallowamine | 2.6 | Unchanged |
| c) Dimethyltallowamine | 1.6 | Slight fading |
| d) Control | — | Bad fading |

The control sleeve had changed from moss green to a yellow green.

EXAMPLE 8

Yarn similar to that of Example 4 was sprayed with the various antiozonants listed below, then autoclaved at 270° F., and dyed Olive II as in Example 10. The dyed sleeves were then exposed to three cycles of exposure to 10 pphm ozone at 104° F. and 95% relative humidity.

The antiozonants used, the amount of pickup and the visual appearance after exposure to ozone are as follows:

| Chemical | % Pickup | Visual appearance after 3 cycles exposure |
|---|---|---|
| Dimethyltallowamine | 1.5 | No change from unexposed |
| Dimethylstearylamine | 1.0 | No change from unexposed |
| N-Cocomorpholine | 1.2 | Slightly more fading than above |
| Varonic K202P* | 1.0 | Slight change |

EXAMPLE 9

Yarns similar to those of Example 1 were heat treated (autoclaved) at 270° F. and then dyed moss green but using 0.25% C.I. Basic Blue 22, instead of Astrazon Blue 3RL. The dyed sleeves were then solution-coated and exposed to ozone as in Example 1. The chemicals used, the antiozonant pickup, and the results of exposure to three cycles of exposure to 80 pphm of ozone at 104° F., and 95% relative humidity are shown below.

| Solution | % Pickup | ΔE |
|---|---|---|
| a) Dimethyltallowamine in 200 ml ethanol | 1.0 | 3.2 |
| b) Trilaurylamine in 200 ml ethanol | 1.4 | 4.0 |
| c) Control, just 200 ml ethanol | — | 25.2 |

EXAMPLE 10

Autoclaved dyed sleeves similar to those of Example 4 except using 0.069% O.W.F. C. I. Disperse Blue 7 instead of C. I. Disperse Blue 3 were solution-coated with the following chemicals and then exposed to ozone as in Example 4. The solutions used, the percent pickup and the results of ozone exposure are as follows:

| Solution | % Pickup | ΔE |
|---|---|---|
| a) Methyldicocoamine 1 gm in 200 ml ethanol | 1.9 | 2.7 |
| b) Triheptylamine 1 gm in 200 ml ethanol | 1.8 | 3.1 |
| c) Control, just 200 ml ethanol | — | 11.3 |

EXAMPLE 11

Polymer made from caprolactam, having a formic acid relative viscosity of about 55 with about 50 amine equivalents and about 50 carboxyl equivalents per million grams of polymer was spun into yarn, coated with a commercial spin finish, drawn at a 3.2 draw ratio, and plied to give a yarn of 2100 total denier with a denier per filament of 15. The yarn had a Y cross-section of 3.2 modification ratio. This yarn was knitted into sleeves, and heat set as in Example 1.

This yarn was dyed with 0.1% O.W.F. Latyl Cerise Y (C.I. Disperse Red 55) and then solution-coated with the chemicals listed below. The solution-coated sleeves were then exposed to 10 hours of xenon light in an Atlas Weatherometer. The sleeves were then taken out and the dye light fastness noted. The solutions, the pickup and the results of the dye light fastness test are as follows:

In the following table AATCC Test Method 16E-1971 was used. By "break" or "broke" is meant a color change observable to the human eye, Step 4 of the Gray Scale, is found.

| Solution | % Pickup | Color Break |
|---|---|---|
| a) Control, just 200 ml ethanol | — | very slight break |
| b) Ethomeen T12 1 gm in 200 ml ethanol | 0.7 | broke |
| c) Veronic N202P 1 gm in 200 ml ethanol | 0.9 | broke |
| d) Tridecylamine 1 gm in 200 ml ethanol | 0.8 | better than control |
| e) Tridecylamine 1 gm in 200 ml ethanol | 1.0 | better than control |
| f) Dimethylstearylamine 1 gm in 200 ml ethanol | 1.1 | slight break |
| g) Methyldi(70 % arachidyl-30 % behnyl) amine in 200 ml ethanol | 1.7 | equal to control |
| h) Methyldi(90 % arachidyl-10 % behenyl) amine in 200 ml ethanol | 1.9 | equal to control |

Ethomeen T12 is tallowamine reacted with two moles of ethylene oxide. It is sold by Armak, Chemicals Division, Chicago, Illinois. Varonic K202P is cocoamine reacted with two moles of propylene oxide. It is sold by Varney Chemical Company, Des Plaines, Illinois.

All of the above chemicals are effective antiozonants in the concentrations given above. However, the dyed light fastness obtained by using the tertiary amine is appreciably better than when the alkanolamines are used. Latyl Cerise is a dye frequently used by dyers of carpets. Its performance in this light fastness test is representative of the light fastness of many dyes in its dye class.

EXAMPLE 12

Cationic dyeable fibers made as in Example 1 were dyed a basic moss green as in Example 1 and solution-coated with the chemicals listed below. The solution-coated sleeves were then exposed to 10, 20, and 30 hours of xenon light in an Atlas Weatherometer and the number of hours to the first visible color break noted, as in Example 11.

| Solution | Hours to Break |
|---|---|
| Control | 20 |
| Ethomeen T12 | 10 |
| Varonic K202P | 10 |
| Dimethyl(hydrogenated tallow)amine | 20 |

EXAMPLE 13

Fibers made as in Example 11 were dyed a light green shade using the following disperse dyes: 0.117% Disperse Yellow 3; 0.037% Disperse Blue 7, 0.05% Cibacete Cerise GNB from Ciba-Geigy. The dyed sleeves were solution-coated and exposed to 20, 40, 60 and 80 hours of xenon light in an Atlas Weatherometer and the number of hours to the first visible color break noted as in Example 11.

| Solution | Hours to Break |
|---|---|
| Control | 60 |
| Varonic K202P | 20 |
| Dimethyltallowamine | 60 |
| N-Cocomorpholine | 60 |
| Dimethylstearylamine | 60 |

EXAMPLE 14

Polymer made from caprolactam, having a formic acid relative viscosity of about 55, about 48 equivalents of carboxyls and about 48 equivalent of amines per million grams of polymer, was spun into yarn having a "Y" cross section with a 3.0 modification ratio. The yarn was coated with a commercial aqueous spin finish and drawn at a draw ratio of about 3.0 to give a yarn of 1125 denier with 70 filaments.

The yarn was drawn at a 3.3 draw ratio, texturized with a steam jet texturizer and then 2-plied to a yarn of 2600/140 denier. The yarn was knitted into sleeves and autoclaved at 270° F. as described in Example 1.

Half of the sleeve was dyed Olive I, as described in Example 4. The dyed and undyed sleeves were cut into five sections, each about 6 inches long, and each section was weighed. The sleeves were then soaked in the ethanol solutions listed below for 20 minutes. The sleeves were removed from solution, allowed to air-dry and reweighed. The amount of material coated on the sleeves from each solution was based on the difference in weight between the treated and untreated sleeves, compared to the controls, which were soaked in pure ethanol.

The undyed sleeve sections were then dyed Olive I as described above. All the sleeves were then exposed to three cycles of ozone at 20 parts per hundred million of ozone at a temperature of 104° F., and a relative humidity of at least 95%.

The solutions, the amount of coating and the results of ozone exposure are as follows, where the first five samples were dyed before coating and the last five were dyed after coating on the tertiary amine.

| Solution | % Pickup | Δ E |
|---|---|---|
| Control, 200 ml ethanol | — | 22.7 |
| Trilaurylamine, 1 gm in 200 ml ethanol | 1.87 | 4.8 |
| Trilaurylamine, 2 gm in 200 ml ethanol | 4.55 | 0.8 |
| N-Cocomorpholine 1 gm in 200 ml ethanol | 1.50 | 5.1 |
| N-Cocomorpholine 2 gm in 200 ml ethanol | 2.72 | 3.1 |
| Control, 200 ml ethanol | — | 24.1 |
| Trilaurylamine, 1 gm in 200 ml ethanol | 1.56 | 2.4 |
| Trilaurylamine 2 gm in 200 ml ethanol | 3.05 | 1.5 |
| N-Cocomorpholine 1 gm in 200 ml ethanol | 1.05 | 5.6 |
| N-Cocomorpholine 2 gm in 200 ml ethanol | 1.83 | 9.9 |

We claim:

1. A method of treating polycarbonamide fibers to increase dye fastness of basic and disperse anthraquinone dyestuffs applied in an aqueous dyebath when said fibers are dyed and exposed to ozone comprising coating said fibers prior to dyeing with from about 0.5 percent to about 4.0 percent on weight of fiber of a compound selected from the group consisting of

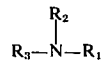

where $R_1$ is straight or branched alkyl, alkenyl or aralkyl having 6 to 24 carbon atoms; $R_2$ is the same as $R_1$, another $R_1$ or a straight or branched chain alkyl or alkenyl having one to six carbon atoms; $R_3$ is the same as $R_2$ or another $R_2$; the total carbon atoms in $R_1$, $R_2$, and $R_3$ must be at least 15 and less than 40; and $R_1$, $R_2$, and $R_3$ can contain up to 2 unsaturated carbon to carbon bonds, said coating remaining on said fibers after all subsequent processing.

2. The method of claim 1 wherein said compound is coated in an amount of from about 0.6% to about 3% on weight of fiber.

* * * * *